US006688146B2

(12) United States Patent
Michels et al.

(10) Patent No.: US 6,688,146 B2
(45) Date of Patent: Feb. 10, 2004

(54) TWIST CLOSURE

(75) Inventors: Horst Michels, Solingen (DE); Jürgen Henkels, Solingen (DE)

(73) Assignee: S. Franzen Söhne GmbH & Co. KG, Solingen (DE)

( * ) Notice: Subject to any disclaimer, the term of this patent is extended or adjusted under 35 U.S.C. 154(b) by 0 days.

(21) Appl. No.: 10/110,811

(22) PCT Filed: Jul. 20, 2001

(86) PCT No.: PCT/EP01/08384

§ 371 (c)(1),
(2), (4) Date: Aug. 30, 2002

(87) PCT Pub. No.: WO02/14173

PCT Pub. Date: Feb. 21, 2002

(65) Prior Publication Data

US 2003/0089145 A1 May 15, 2003

(30) Foreign Application Priority Data

Aug. 16, 2000 (DE) ..... 10039737

(51) Int. Cl.[7] ..... B65D 55/14
(52) U.S. Cl. ..... 70/169
(58) Field of Search ..... 70/158, 163, 166–169, 70/159–162, 164, 165, 170–173; 220/259.3, 315; 215/206, 208, 294

(56) References Cited

U.S. PATENT DOCUMENTS

| | | | | | |
|---|---|---|---|---|---|
| 757,733 | A | * | 4/1904 | Frank | 70/169 |
| 972,508 | A | * | 10/1910 | Church | 215/206 |
| 1,054,020 | A | * | 2/1913 | Mougette | 137/552.5 |
| 1,349,610 | A | * | 8/1920 | Gibney | 137/371 |
| 1,412,437 | A | * | 4/1922 | Williams | 70/172 |
| 2,731,166 | A | | 1/1956 | Raphael | 215/206 |
| 3,445,021 | A | * | 5/1969 | Johnson | 215/206 |
| 3,901,407 | A | * | 8/1975 | Mitchell et al. | 220/315 |
| 3,998,353 | A | * | 12/1976 | Farelli | 220/210 |
| 4,482,068 | A | * | 11/1984 | Agbay et al. | 215/225 |
| 4,829,796 | A | * | 5/1989 | Kim | 70/168 |
| 5,405,001 | A | * | 4/1995 | Lillard | 206/221 |
| 5,464,109 | A | * | 11/1995 | Greenwald | 215/207 |
| 5,797,422 | A | * | 8/1998 | Tokarz | 137/15.15 |
| 5,911,764 | A | * | 6/1999 | Wei Kong | 70/160 |
| 6,059,132 | A | * | 5/2000 | Benjamin | 215/206 |
| 6,220,064 | B1 | * | 4/2001 | Oddenino | 70/169 |

FOREIGN PATENT DOCUMENTS

| | | |
|---|---|---|
| DE | 814247 | 9/1951 |
| EP | 0740122 | 10/1996 |
| FR | 1511001 | 4/1968 |

* cited by examiner

*Primary Examiner*—John B. Walsh
(74) *Attorney, Agent, or Firm*—Martin A. Farber

(57) ABSTRACT

A rotary closure (1) having a carrying body (5) which carries a plug-in section (6) for plugging into a plug-in opening, in which the plug-in section (6) can be arrested by a retaining element (37) which can be rendered operational or non-operational by a rotary handgrip (4) being rotated, it being possible for the rotary handgrip (4) to be blocked by a combination lock having a plurality of number disks (10). For realizing a rotary closure which is of straightforward, compact construction and which can be used to close plug-in openings of objects of different configurations, there is provided a pull member (33) which can be displaced axially by the rotary handgrip (4) being rotated and is intended for actuating the retaining element (37).

12 Claims, 10 Drawing Sheets

TWIST CLOSURE

FIELD AND BACKGROUND OF THE INVENTION

The invention relates to a rotary closure having a carrying body which carries a plug-in section for plugging into a plug-in opening, in which the plug-in section can be arrested by means of a retaining element which can be rendered operational or non-operational by virtue of a rotary handgrip being rotated, it being possible for this rotary handgrip to be blocked by means of a combination lock having a plurality of number disks.

A rotary closure of the abovementioned type is known from EP 0 740 122 A2, the rotary closure being formed as a trigger-blocking firearm lock. This is associated with the trigger unit of a handgun. The plug-in section is configured in the manner of a toothed strip and can be rendered operational or non-operational in relation to a retaining element by virtue of rotation. This retaining element is configured as a toothed slide which is spring-mounted transversely to the plug-in direction.

SUMMARY OF THE INVENTION

It is an object of the invention for a rotary closure of the generic type, while being of straightforward, compact construction, to be configured such that it can be used in a favorable manner to close plug-in openings of objects of different configurations.

This object is achieved first and foremost in the case of a rotary closure having the features of claim 1, this being based on providing a pull member which can be displaced axially by virtue of the rotary handgrip being rotated and is intended for actuating the retaining element.

Such a configuration gives a rotary closure of the type in question which is suitable for closing plug-in openings of different objects. These objects may be, for example, canisters, bottles or other types of container. For the purpose of closing a corresponding plug-in opening, the rotary closure has to be inserted into the plug-in opening by way of its plug-in section, which contains the retaining element. Rotation of the rotary handgrip then makes it possible to displace an axial pull member which, for its part, actuates the retaining element and moves the latter into the closed position in relation to the plug-in section. The more the pull member is displaced axially, the more intimately is the retaining element fitted within the plug-in opening. If the retaining element has reached its firmly seated position, the secret code of the combination lock may be adjusted if this has not already taken place, so that it is then no longer possible for the pull member to be actuated in order to render, for example, the retaining element non-operational. This proves to be advantageous in functional terms if the pull member is guided in a rotationally fixed manner in the carrying body and is in threaded engagement with the rotary handgrip. This makes it possible for the pull member to be adjusted in a stepless manner. Furthermore, co-rotation of the pull member during rotary adjustment and corresponding adverse effects on the axial displacement are prevented. Emphasis should, further, be placed on the fact that the retaining element is a compressible tube which increases in diameter by virtue of an axial pressure being applied. This configuration is suitable predominantly in the case of plug-in openings of bottles. For example, it is possible for parents to secure a spirit-containing bottle which has not yet been used up so that children cannot open it. It is also possible for bottles which contain cleaning agents etc. to be secured in this way. In order for it to be possible for the construction of the rotary closure to be of compact configuration, the number disks are oriented in a star-shaped manner in relation to the axis of rotation of the rotary handgrip and are seated on individual spindles. It is favorable in handling terms if the carrying body and the rotary handgrip overlap substantially completely in cross-section. In order to prevent the rotary handgrip from being rotated back once the secret code has been adjusted, there are provided blocking pins which run parallel to the axis of rotation and engage in blocking cutouts of the carrying body. The blocking cutouts are advantageously configured such that, once the secret code has been adjusted, they allow the rotary handgrip to be rotated forward in order to displace, for example, the pull member in the axial direction, this being accompanied by diameter-increasing compression of the compressible tube. In this case, the blocking pins run over the blocking-cutout flanks configured in the form of run-on slopes. In order for this to be possible, the run-on slopes are yieldable under spring loading. The combination lock is favorably constructed such that the blocking sleeves, which are rotationally coupled to the number disks, each have a flattened portion which, in the release position, is located in front of a head of the blocking pins, which are spring-loaded in the direction of the blocking sleeve. In accordance with the number of number disks, there is thus a corresponding number of blocking pins, which interact with the blocking sleeves associated with them. The operation of setting the predetermined secret code then presupposes that the blocking sleeves are rotated, via the number disks, such that the flattened portions are located in front of the heads of the blocking pins. Accordingly, these blocking pins may be displaced under spring loading such that they do not project into the blocking cutouts. As has already been mentioned in the introduction, such a rotary closure may favorably be configured as a bottle closure. The secret code may be altered as in the case of known combination locks. For this purpose, there is mounted in the rotary handgrip a rotary star which has actuating arms located in front of the blocking sleeves. The rotary star forms a hub through which the threaded spindle of the pull member passes and which has a tool-engagement surface. This makes it possible, for example by means of a screwdriver or by means of a coin, for the rotary star to be displaced, this being, combined with displacement of the blocking sleeves, which in the process are uncoupled from the number disks. The latter, for their part, may then be rotated in order for a different secret code to be selected. The operation of altering the secret code, however, presupposes that the blocking sleeves have previously been rotated such that the flattened portions of the blocking sleeves are located in front of the heads of the blocking pins.

BRIEF DESCRIPTION OF THE DRAWINGS

An exemplary embodiment of the invention is explained hereinbelow with reference to the drawings, in which.

DETAILED DESCRIPTION OF THE PREFERRED EMBODIMENTS

Figure 4:
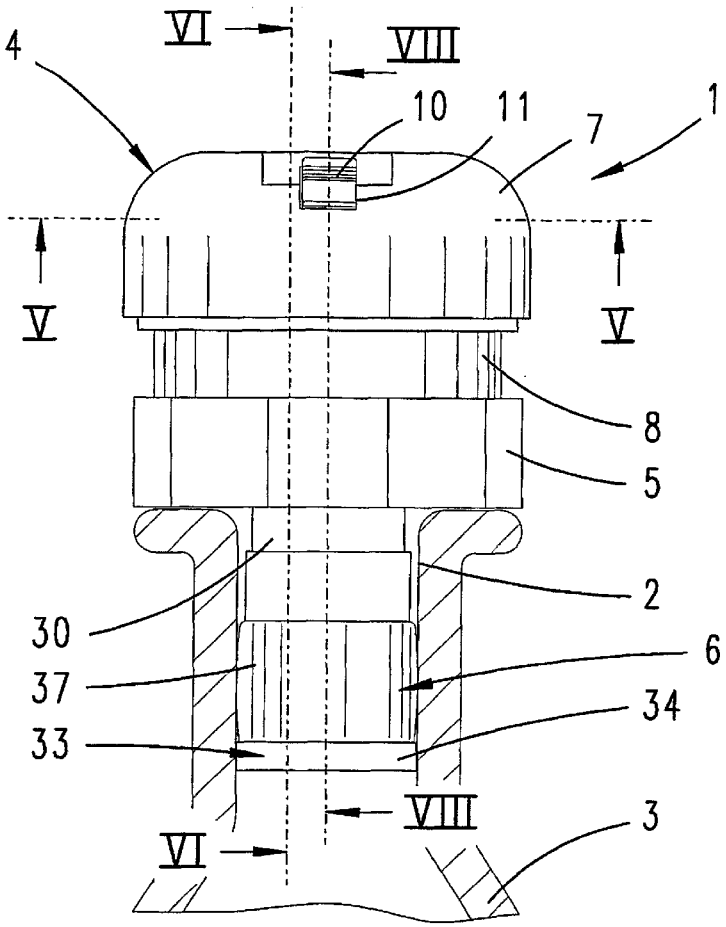
FIG. 4 shows an illustration as in FIG. 1, but with the compressible tube operational.
Figure 5:
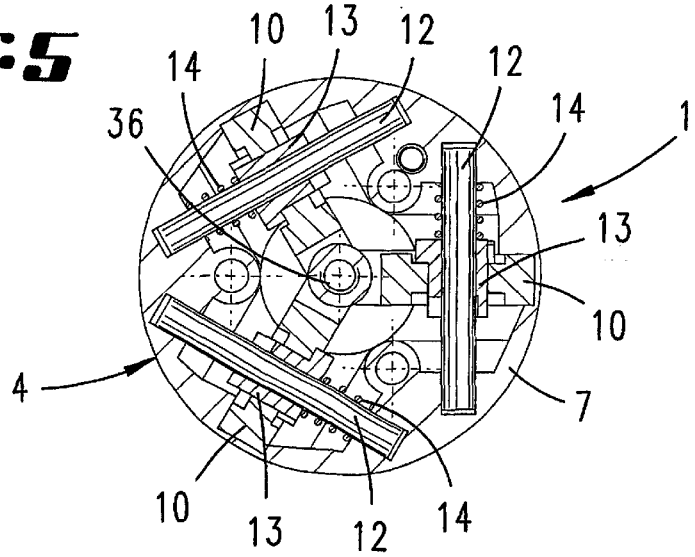
FIG. 5 shows the section along line V—V in FIG. 4.

The rotary closure is designated overall by the numeral 1. According to the exemplary embodiment, it is in the form of a bottle closure, so that it is possible to use it to close the plug-in opening 2 of a bottle 3 firmly in a sealed manner, see FIG. 4 in particular.

In specific terms, the rotary closure 1 has a rotary handgrip 4, which is circular in plan view, a carrying body 5, which is ten-sided in plan view, and a plug-in section 6, which projects beyond the end side of the carrying body 5. The carrying body 5 and the rotary handgrip 4 here overlap completely in cross-section.

Figure 3:
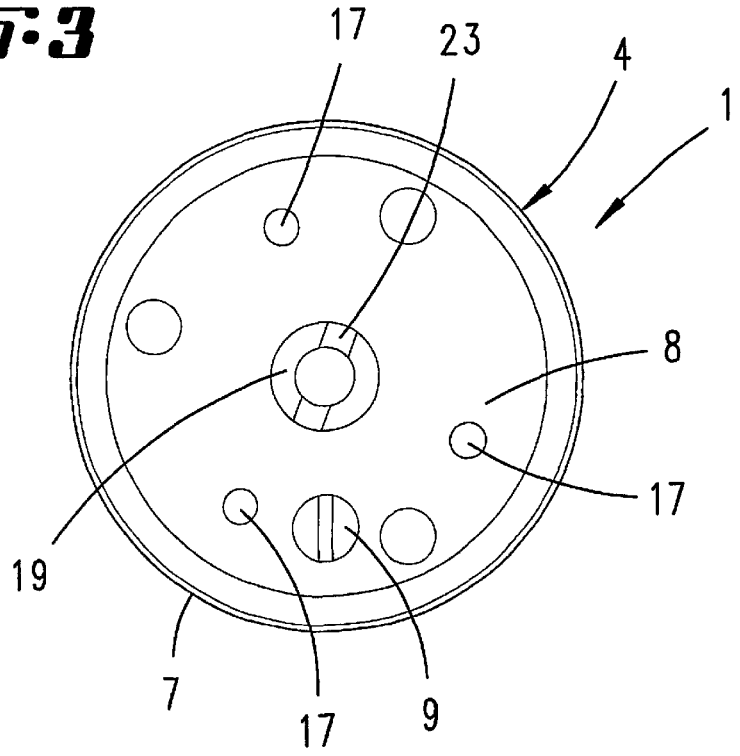
FIG. 3 shows a bottom view of the rotary handgrip, with the tool-engagement surface of the rotary star being visible.

The rotary handgrip 4 is made up of two housing parts 7 and 8 which are disposed axially one behind the other and are connected firmly to one another by means of a screw 9. The latter is screwed in from the lower end side of the housing part 8, as seen in FIG. 3. In the housing part 7, three number disks 10 are oriented in a star-shaped manner in relation to the axis of rotation of the rotary handgrip 4. Each number disk 10 engages, with part of its circumference, into in each case one cutout 11 of the housing part 7, so that the number disks 10 are accessible from the end corner region of the housing part 7. The number disks 10, for their part, are seated on individual spindles 12 which are positioned in a chord-like manner in the housing part 7 and form the sides of an approximately isosceles triangle. These engage through the number disks 10, with the interposition of blocking sleeves 13. These are in alterable coupling engagement with the number disks 10. Ten coupling-engagement positions are possible, in accordance with the number of digits on the circumference of the number disks. The engagement position of the blocking sleeve 13 in relation to the number disk 10 is maintained by a compression spring 14 seated on the spindle 12.

Figure 6:
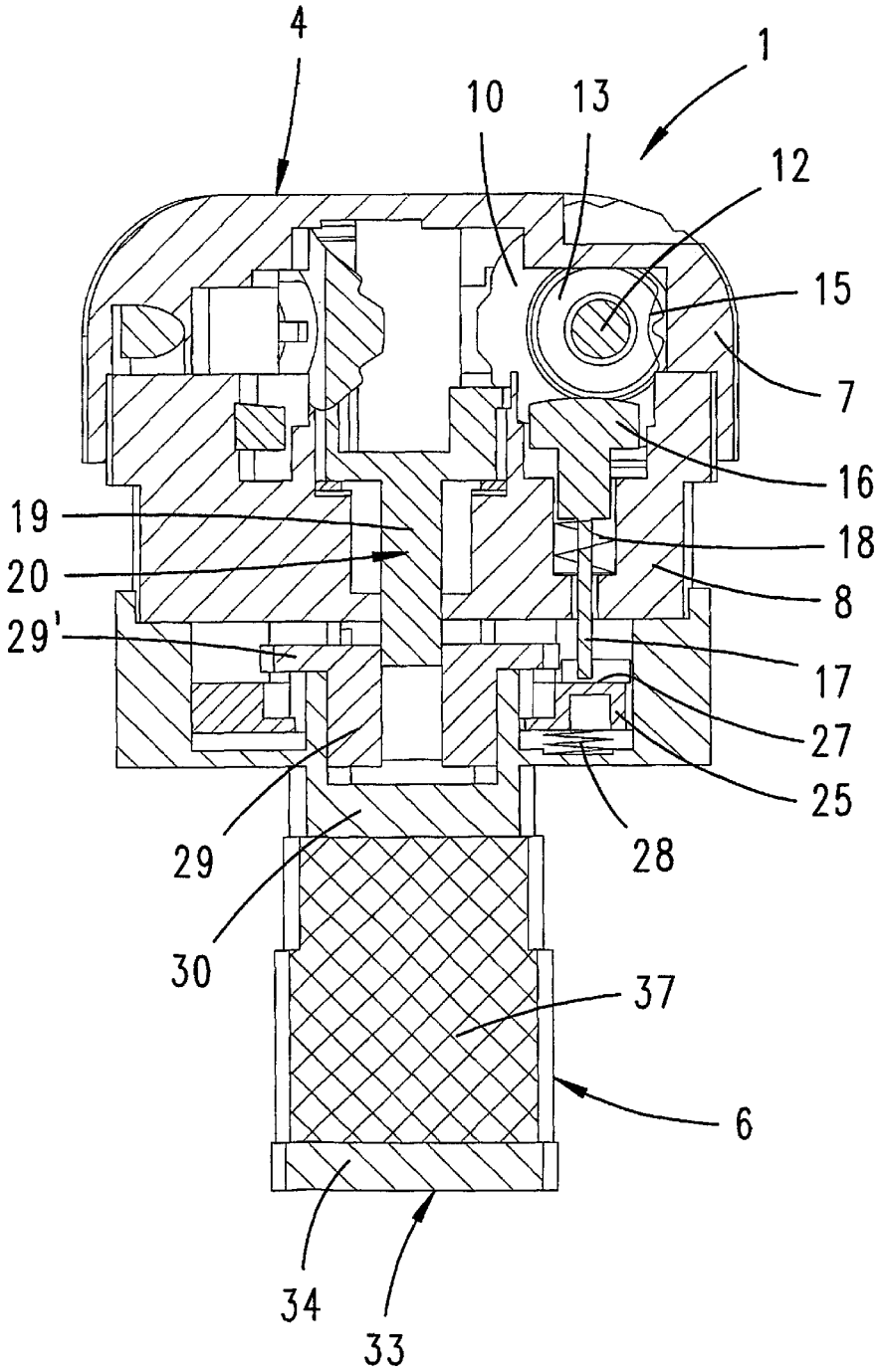
FIG. 6 shows the section along line VI—VI in FIG. 4.
Figure 7:
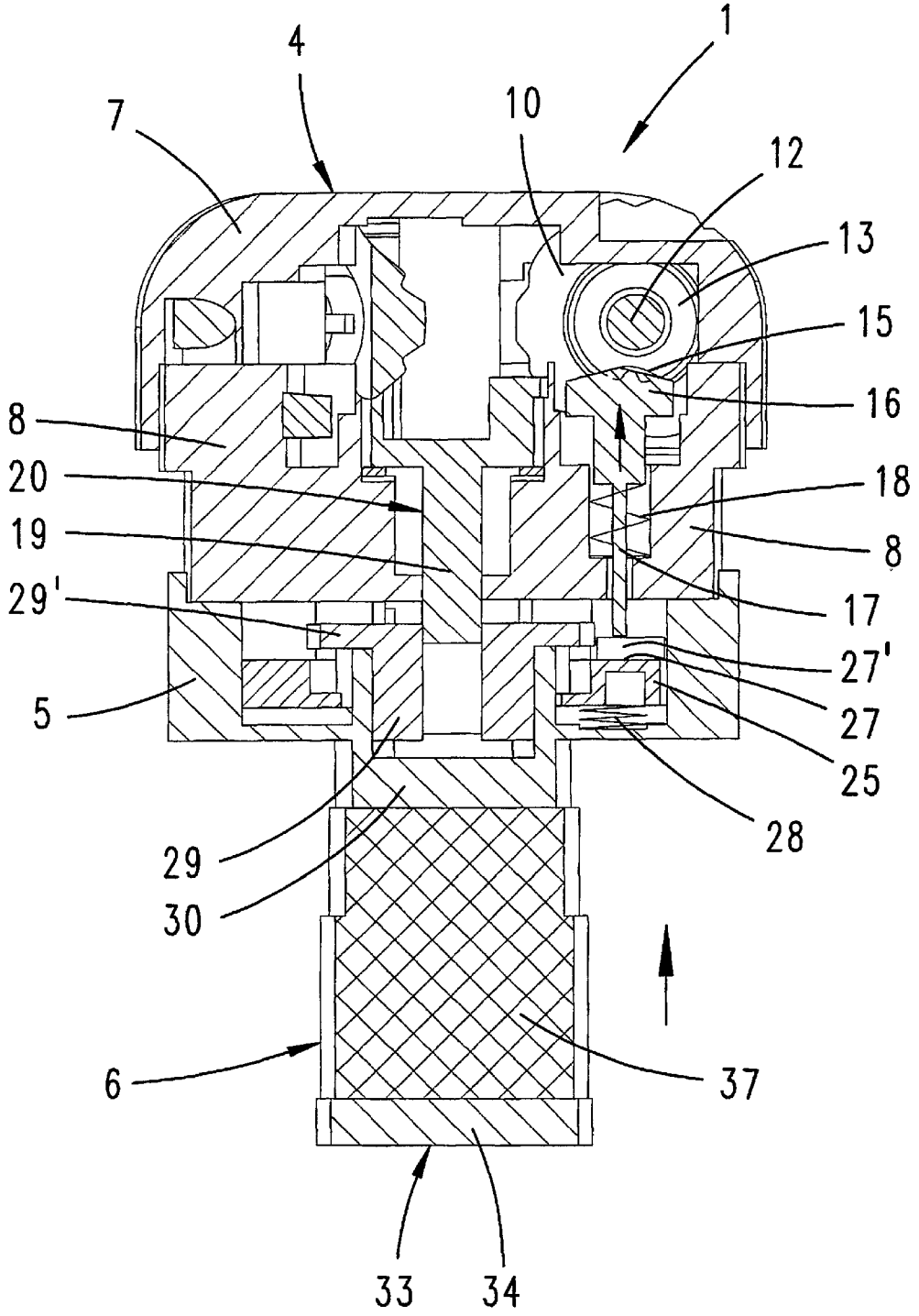
FIG. 7 shows a section which is comparable with FIG. 6, but with the secret code set correctly.

Each blocking sleeve 13 is provided on its periphery with a flattened portion 15 which, with the secret code set correctly, is located in front of a head 16 of a blocking pin 17, which is spring-loaded in the direction of the blocking sleeve 13. Since there are three blocking sleeves 13, three blocking pins 17 extend, with uniform angle distribution, in the housing part 8. They are thus guided in the housing part 8 in an axis-parallel manner in relation to the axis of rotation of the rotary handgrip 4. Compression springs 18 subject the blocking pins 17 to loading in the direction of the blocking sleeves 13. If the number disks 10, and thus the blocking sleeves 13, are rotated and moved into the position according to FIG. 6, then the blocking sleeves 13 act, by way of their circular periphery, on the head 16 of the blocking pins 17 and displace these in the axially outward direction, this being accompanied by the blocking pins 17 projecting to a greater extent beyond the lower end border of the housing part 8, see FIGS. 6 and 7.

The hub 19 of a rotary star 20 is mounted centrally in the housing part 8. Three actuating arms 21 extend tangentially from the hub 19, these actuating arms interacting with the facing end sides of the blocking sleeves 13. By virtue of the rotary star 20 being rotated, it is thus possible for the blocking sleeves 13 to be uncoupled from the number disks 10, the blocking sleeves 13 being displaced counter to the force of the compression springs 14. The rotary displacement is accompanied by a small degree of axial displacement of the hub 19, which has a compression spring 22 acting on it. Accordingly, for the purpose of resetting the secret code, the actuating arms remain in the position in which the blocking sleeves 13 are uncoupled. If the secret code has been reset, then rotary displacement of the rotary star 20 is only possible following previous axial displacement. It is then possible for the blocking sleeves, on account of their spring loading, to be coupled again to the number disks 10.

The free end of the hub 19 engages through the lower end surface of the housing part 8 and projects beyond the same. A tool-engagement surface 23 in the form of a diametral slot is located in the projecting section.

In order to rule out any undesirable self-adjustment of the number disks 10, the hub 19 of the rotary star 20 carries a spring ring 24 with radially directed arms 24' which, for their part, interact with notches 10' in the number disks 10. In accordance with the number of digits on the number disks 10, there is also a corresponding number of notches 10' present.

Figure 9:
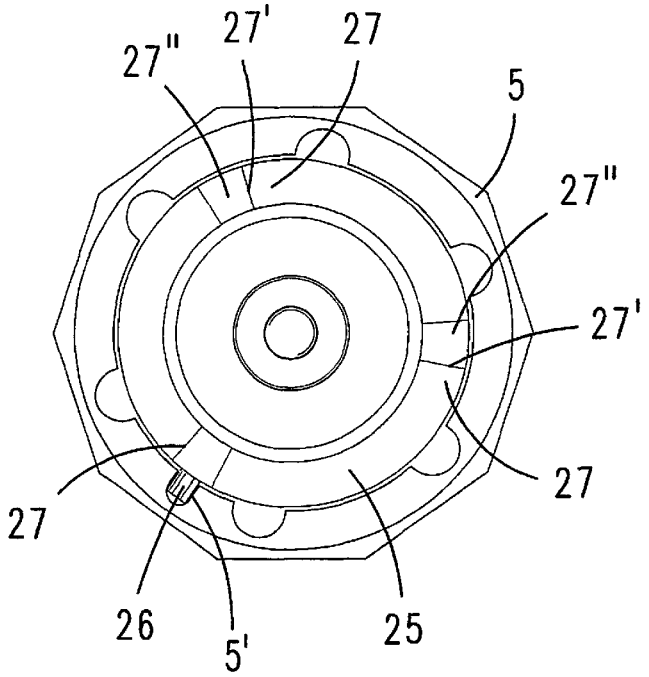
FIG. 9 shows a plan view of the carrying body, that is to say with the rotary handgrip omitted.
Figure 10:
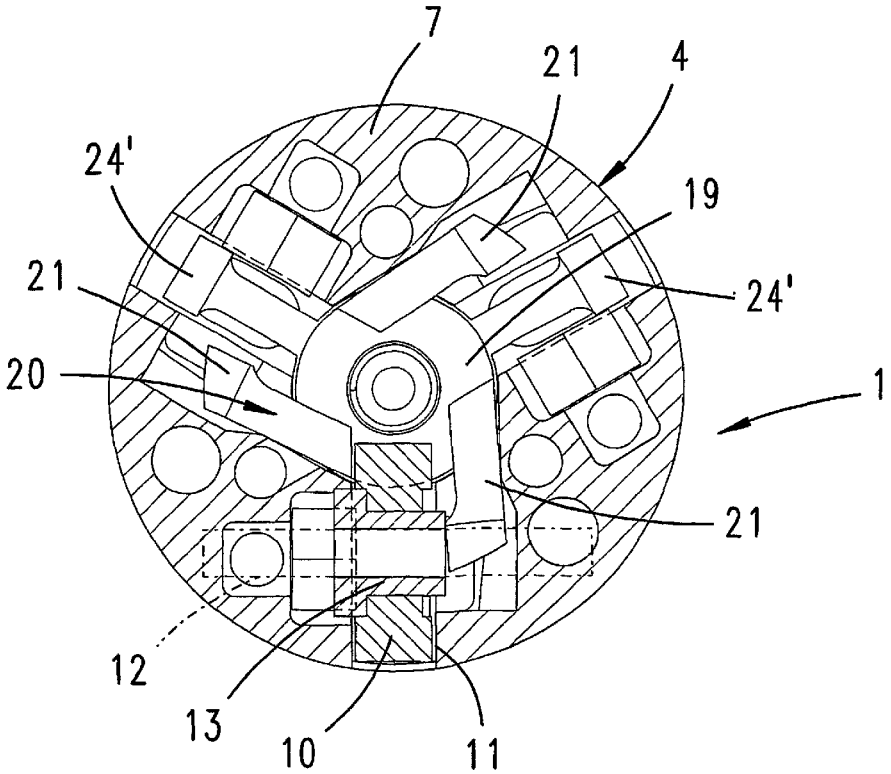
FIG. 10 shows the section along line X—X in FIG. 8, that region of the rotary handgrip which accommodates the number disks being omitted.
Figure 11:
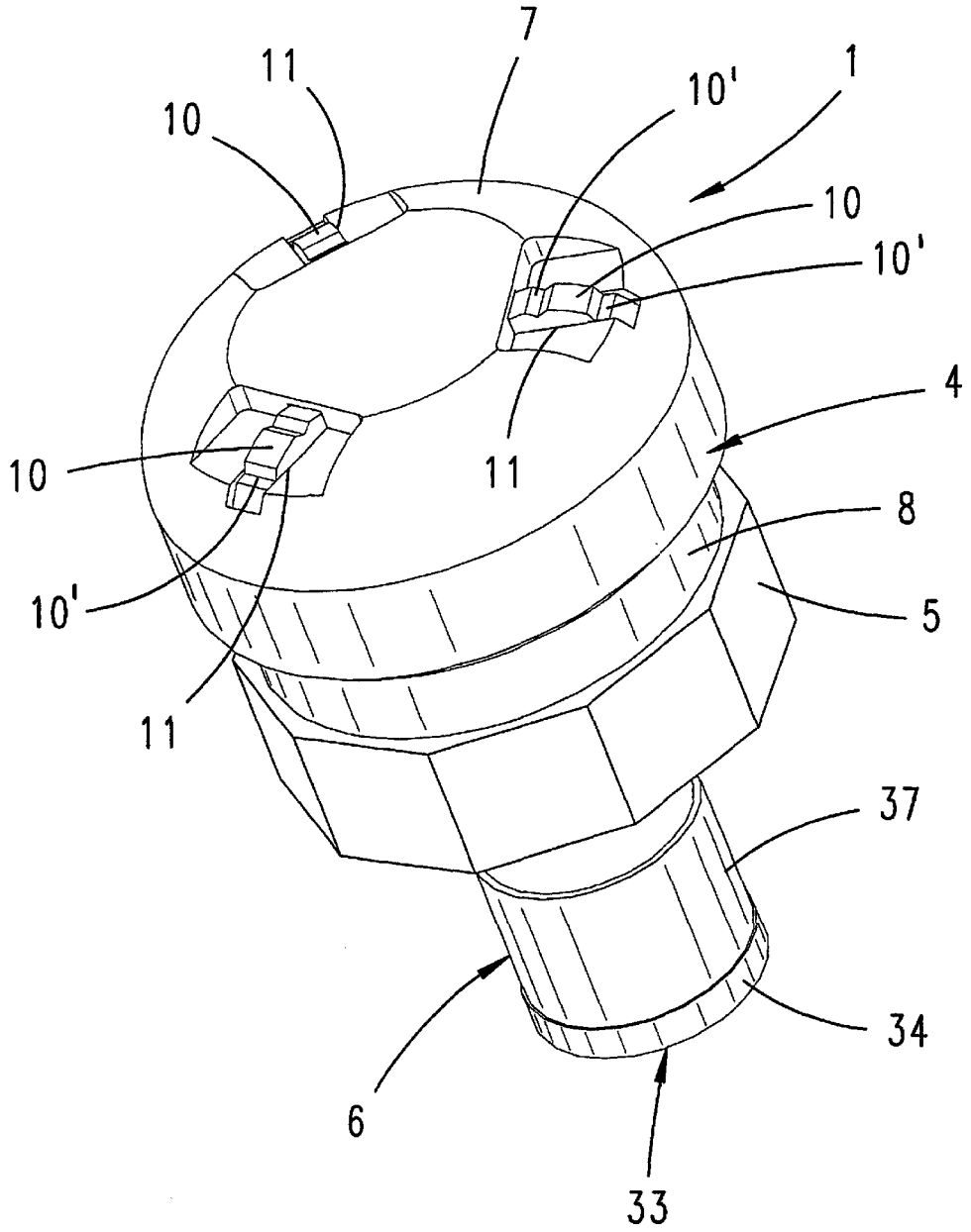
FIG. 11 shows a perspective illustration of the rotary closure.
Figure 12:
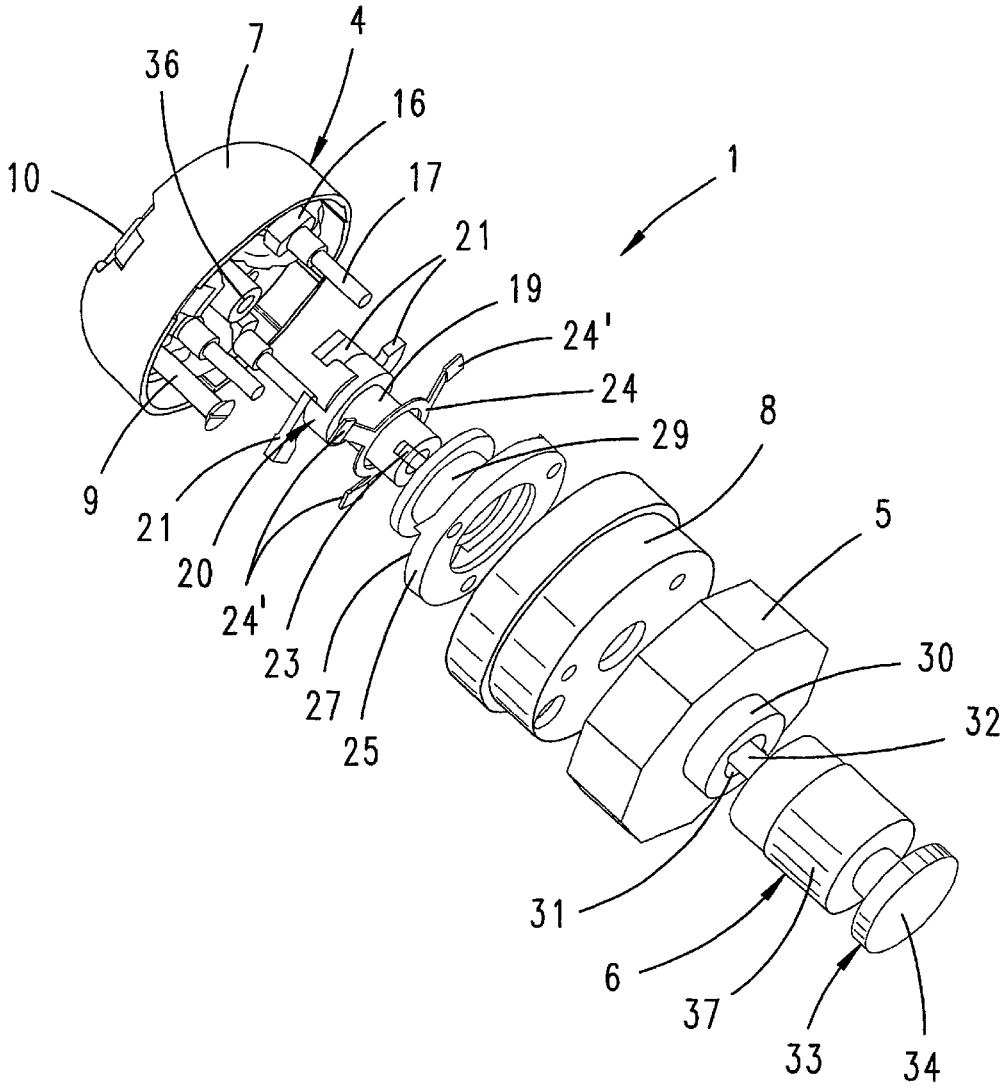
FIG. 12 shows the exploded illustration, in perspective, of the rotary closure.
Figure 13:
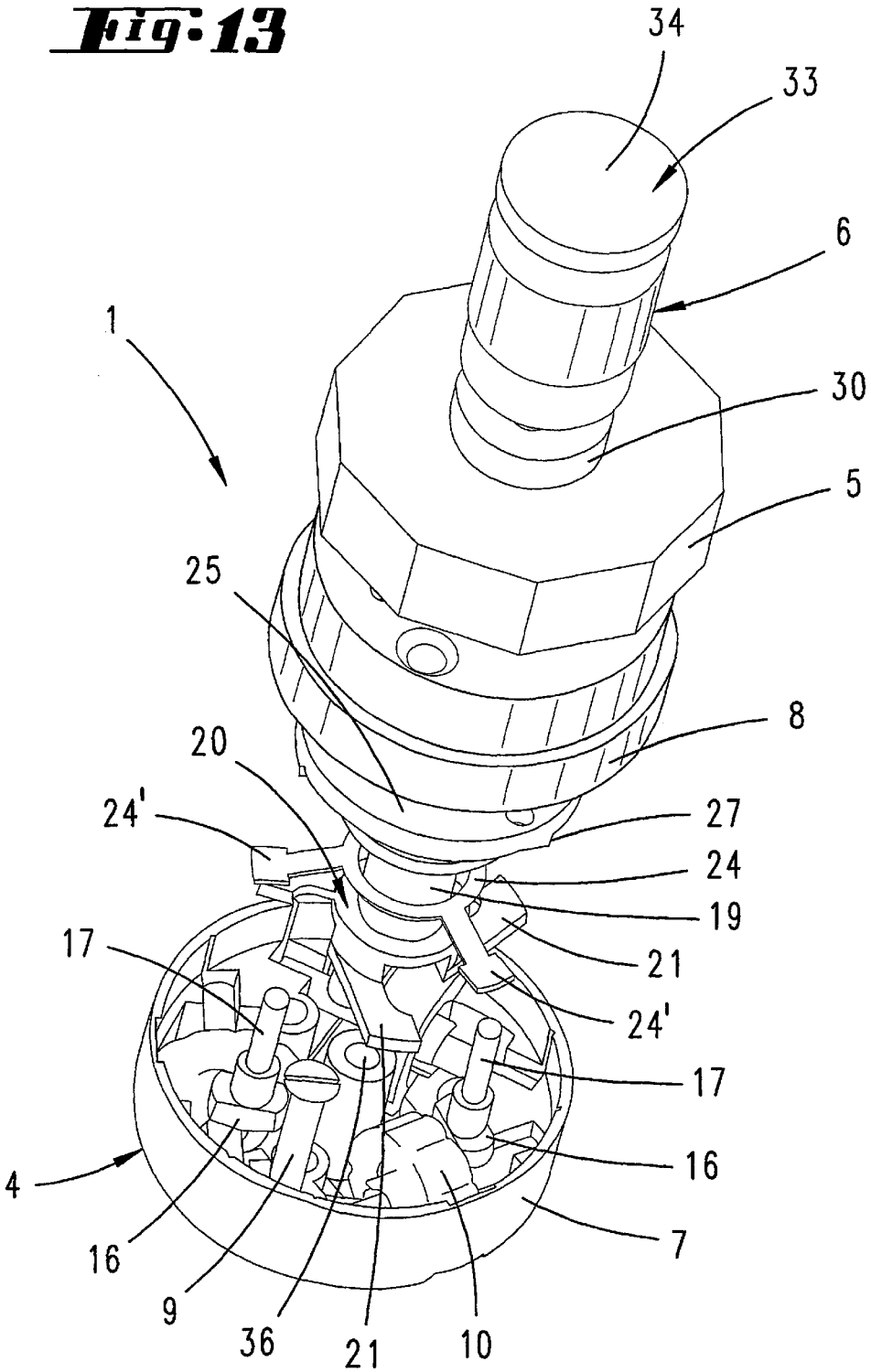
FIG. 13 shows another perspective of the rotary closure in the non-assembled state.

The carrying body 5, which partially encloses the lower border of the housing part 8, allows the rotary handgrip 4 to be rotated. The carrying body 5 accommodates a rotationally secured blocking ring 25 in its interior. The rotational securing takes place by means of a radial pin 26 of the blocking ring 25, which radial pin 26 penetrates into a radial groove 5' of the carrying body 5, see FIG. 9 in this respect. On its broad surface which is directed toward the blocking pins 17, the blocking ring 25 forms three blocking cutouts 27 which are distributed uniformly over the circumference. With the secret code adjusted, the free ends of the blocking pins 17 engage in these blocking cutouts, see FIG. 6. If the secret code has been properly set, this results in the case according to FIG. 7, in which the blocking pins 17 have their free ends located above the blocking cutouts 27. One flank 27' of the latter runs parallel to the axis of rotation of the rotary handgrip 4, while the other flank 27" is configured in the form of a run-on slope. The blocking ring 25 is spring-loaded in the direction of the blocking pins 17 by means of three compression springs 28 distributed uniformly over the circumference. By way of a radially outwardly directed collar 29', an axially non-displaceable supporting ring 29 inserted into the carrying body 5 limits the axial displacement of the blocking ring 25 under the spring loading.

Figure 8:
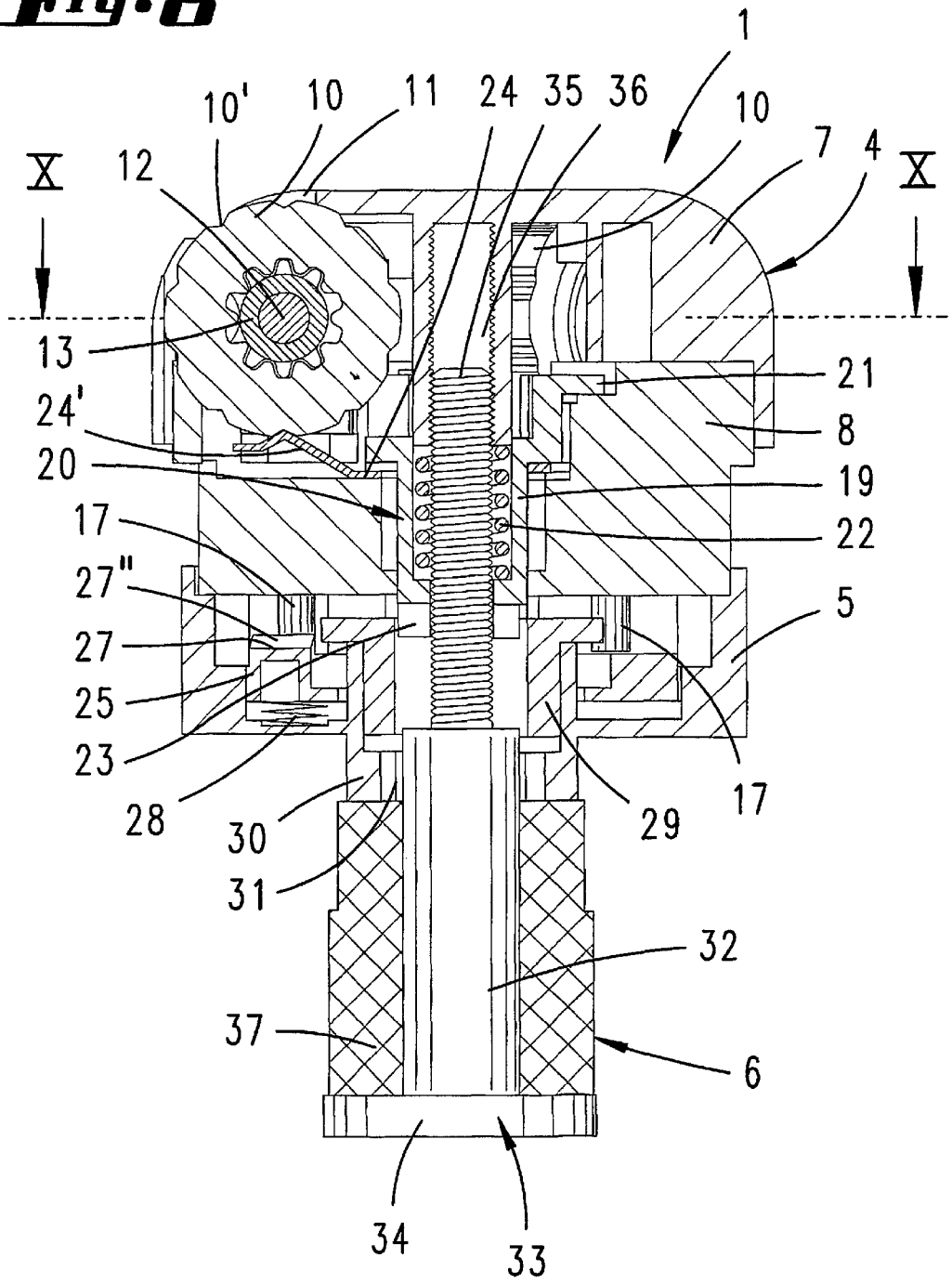
FIG. 8 shows the section along line VIII—VIII in FIG. 4.

On the side opposite to the rotary handgrip 4, the carrying body 5 continues into a reduced-diameter collar 30. This is provided with a central through-passage opening 31 into which the carrying pin 32 of a pull member 33 penetrates. At its lower, free end, the carrying pin 32 continues into a larger-diameter flange plate 34. At its upper end, the carrying pin 32 may be of such a nature that there is no possibility of rotation within the through-passage opening 31, although axial displacement of the pull member is provided. At its upper end, according to FIG. 8, the carrying pin 32 continues into a threaded spindle 35. This engages through the hub 19 of the rotary star 20 and penetrates into the internal thread 36 of the housing part 7 of the rotary handgrip 4, see FIG. 8 in this respect. Between the flange plate 34 and the collar 30, the carrying pin 32 carries a retaining element 37 which, in the exemplary embodiment, is configured in the form of a compressible tube. When the compressible tube 37 is relieved of stressing, its diameter is somewhat smaller than that of the flange plate 34. The diameter of the flange plate 34, in contrast, is somewhat smaller than that of the plug-in opening 2 of the bottle 3.

Figure 1:
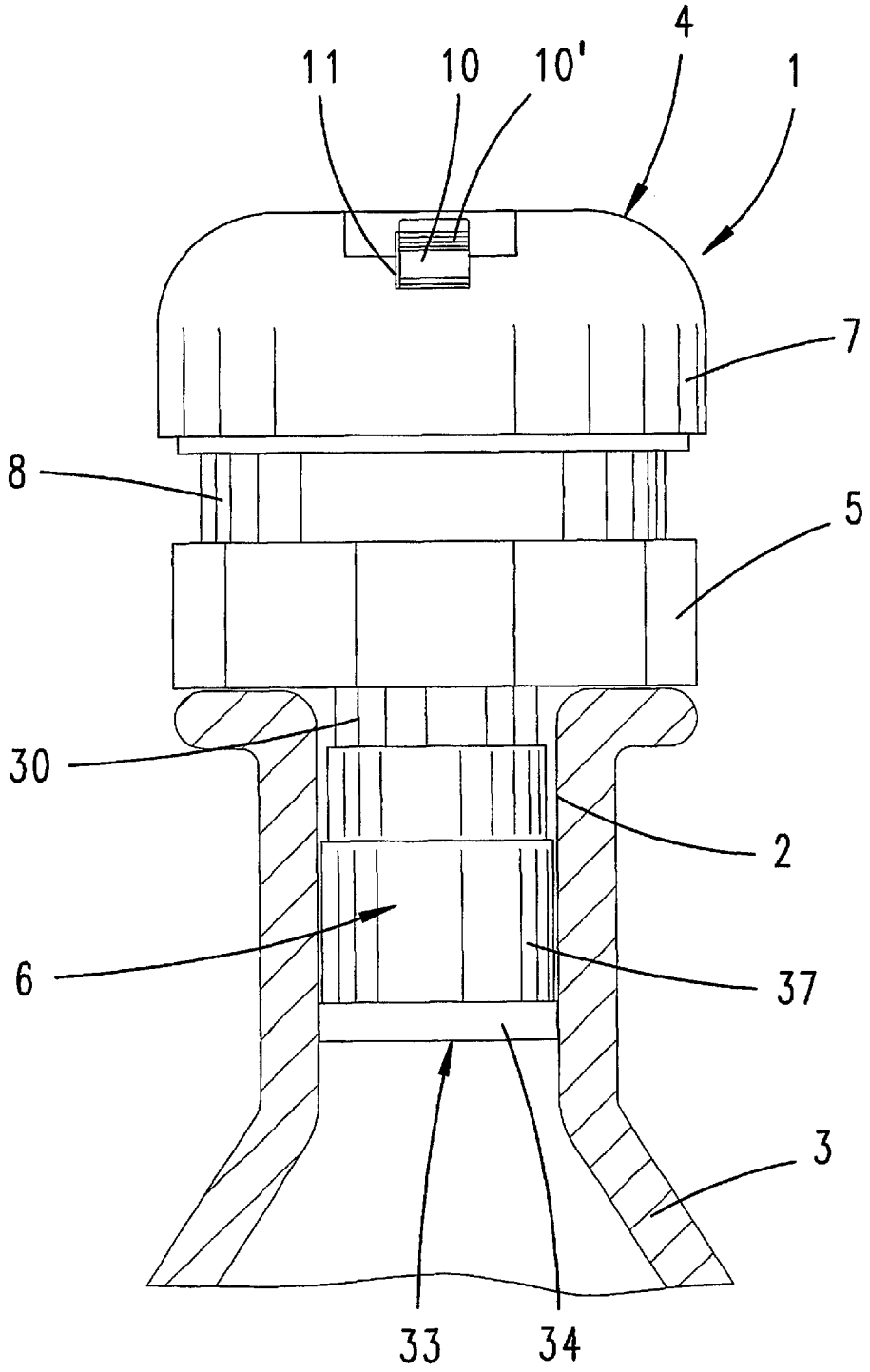
FIG. 1 shows a view of a rotary closure which is configured according to the invention and is associated with a plug-in opening of a bottle, the compressible tube not yet being operational.
Figure 2:
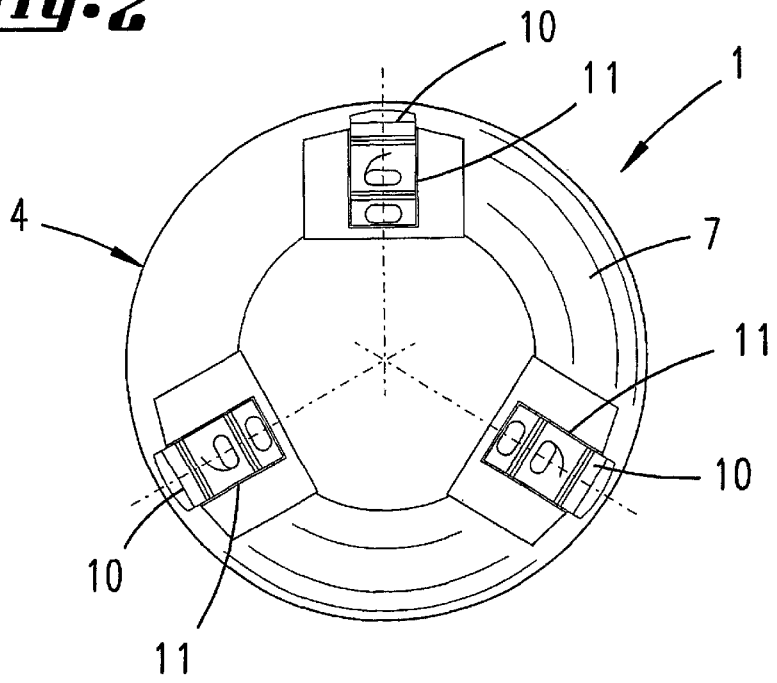
FIG. 2 shows a plan view of the rotary closure.

Functioning is as follows: if the plug-in opening 2 of a bottle 3 is to be secured in a liquid-tight manner, then the rotary closure is to be fitted such that the plug-in section 6 is inserted into the plug-in opening 2. The plug-in operation is possible with the compressible tube 37 relieved of stressing, in which case this compressible tube assumes the position according to FIGS. 1 and 8. The rotary handgrip 4 is then to be rotated in the clockwise direction, this being accompanied by the threaded spindle 35 being displaced inward into the rotary handgrip 4. The flange plate 34 is displaced in this case, the compressible tube 37 being clamped in between the collar 30 and the flange plate 34, and thus increasing in diameter. The rotary displacement of the rotary handgrip 4 here may take place with the secret code either set or adjusted. If the secret code has been adjusted, then, although the blocking pins 17 project into the blocking cutouts 27, the blocking pins run over the flanks 27' and, in the process, displace the blocking ring 25 in a ratchet-like manner in the direction of the base of the carrying body 5. If the secret code has been set, then there is no ratchet-like action. Following sufficient rotation of the rotary handgrip 4 and increase in diameter of the compressible tube 37, it is then possible for the secret code to be adjusted if this has not already been done. It is then no longer possible, on account of the blocking cutouts 27, for the rotary handgrip 4 to be rotated back. In order for it to be possible to remove the rotary closure 1, it is then necessary for the secret code to be set. Accordingly, the blocking pins 17 are consequently displaced, so that the free ends of the same leave the blocking cutouts 27 of the blocking ring 25. The rotary handgrip 4 is then free for being rotated back, this latter operation allowing the pull member 33 to be displaced and the compressible tube 37 to be relieved of stressing.

If it is intended to alter the secret code, then the plug-in section 6 has to be released completely from the rotary handgrip 4, this presupposing that the rotary handgrip 4 has been unscrewed from the threaded spindle 35. Thereafter, the tool-engagement surface 23 is accessible, which allows the blocking sleeves 13 to be uncoupled from the number disks 10, as has been described in the introduction.

The cross-sectional shape of the compressible tube 37 and/or of the plug-in section may be selected differently in accordance with the cross-sectional shape of the plug-in opening which is to be closed in each case.

We claim:

1. A rotary closure in the form of a bottle closure having a carrying body (5) which carries a plug-in section (6) for plugging into a plug-in opening (2), in which the plug-in section (6) is arrestable by means of a retaining element (37) which is rendered operational or non-operational by a rotary handgrip (4) being rotated, wherein said rotary handgrip (4) is blockable by a combination lock having a plurality of number disks (19), the number disks (10) which are associated with the rotary handgrip, being star oriented with respect to an axis of rotation of the rotary handgrip (4) and being seated on individual spindles (12).

2. The rotary closure as claimed in claim 1, wherein the carrying body (5) and the rotary handgrip (4) overlap substantially completely in cross-section.

3. The rotary closure as claimed in claim 1, wherein blocking pins (17) which run parallel to the axis of rotation of the rotary handgrip and engage in blocking cutouts (27) of the carrying body (5).

4. The rotary closure as claimed in claim 3, wherein one flank (27") of the blocking cutout (27) forms a run-on slope.

5. The rotary closure as claimed in claim 4, wherein the run-on slopes (27") are yieldable under spring loading.

6. The rotary closure as claimed in claim 3, further comprising blocking sleeves (13) which are rotationally coupled to the number disks (10) and have a flattened portion (15) which, in a release position, is located in front of a head (16) of the blocking pin (17), which is spring-loaded in direction of the blocking sleeve (13).

7. The rotary closure as claimed in claim 6, further comprising a rotary star (20) which is mounted in a rotationally adjustable manner in the rotary handgrip (4), has actuating arms (21), the actuating arms (21) of the rotary star being located in front of the blocking sleeves (13), and has a hub (19) through which a threaded spindle (35) passes and which has a tool-engagement surface (23).

8. A rotary closure (1) having a (carrying body (5) which carries a plug-in section (6) for plugging into a plug-in opening (2), in which the plug-in section (6) is arrestable by means of a retaining element (37) which is rendered operational or non-operational by a pull member which is displacable axially by a rotary handgrip (4) being rotated, wherein the rotary handgrip (4) is blockable by a combination lock, wherein the combination lock has a plurality of number disks which are associated with the rotary handgrip, said rotary handgrip (4) being in threaded engagement with the pull member (33), said pull member being guided in a rotationally fixed manner in the carrying body (5), wherein blocking pins (17) run parallel to the axis of rotation of the rotary handgrip and engage in blocking cutouts (27) of the carrying body (5).

9. The rotary closure as claimed in claim 8, wherein one flank (27") of the blocking cutout (27) forms a run-on slope.

10. The rotary closure as claimed in claim 9, wherein the run-on slopes (27") are yieldable under spring loading.

11. The rotary closure as claimed in claim 8, further comprising blocking sleeves (13) which are rotationally coupled to the number disks (10) and have a flattened portion (15) which, in a release position, are located in front of a head (16) of the blocking pin (17), which is spring-loaded in direction of the blocking sleeve (13).

12. The rotary closure as claimed in claim 11, further comprising a rotary star (20) which is mounted in a rotationally adjustable manner in the rotary handgrip (4), has actuating arms (21), the actuating arms (21) of the rotary star being located in front of the blocking sleeves (13), and has a hub (19) through which a threaded spindle (35) passes and which has a tool-engagement surface (23).

* * * * *